US011857135B2

(12) United States Patent
Feddema et al.

(10) Patent No.: US 11,857,135 B2
(45) Date of Patent: Jan. 2, 2024

(54) DISHWASHER WITH RACK

(71) Applicant: WHIRLPOOL CORPORATION, Benton Harbor, MI (US)

(72) Inventors: Mark Steven Feddema, Kalamazoo, MI (US); Joseph T. Ferencevich, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/709,669

(22) Filed: Mar. 31, 2022

(65) Prior Publication Data

US 2023/0309784 A1 Oct. 5, 2023

(51) Int. Cl.

| | |
|---|---|
| ***A47L 5/18*** | (2006.01) |
| ***A47L 15/42*** | (2006.01) |
| ***A47L 15/50*** | (2006.01) |
| ***A47L 15/18*** | (2006.01) |

(52) U.S. Cl.

CPC ..... *A47L 15/504* (2013.01); *A47L 15/18* (2013.01); *A47L 15/4278* (2013.01); *A47L 15/503* (2013.01)

(58) Field of Classification Search

None

See application file for complete search history.

(56) References Cited

U.S. PATENT DOCUMENTS

| | | | |
|---|---|---|---|
| 5,649,630 | A | 7/1997 | Remmler |
| 7,445,128 | B2 | 11/2008 | Kaczmarek |
| 9,962,063 | B2 | 5/2018 | Beshears, Jr. et al. |
| 10,716,449 | B2 | 7/2020 | Balinski et al. |
| 2008/0302399 | A1 | 12/2008 | Classen et al. |
| 2019/0290094 | A1* | 9/2019 | Balinski ..... A47L 15/0065 |
| 2019/0290097 | A1 | 9/2019 | Naik et al. |

FOREIGN PATENT DOCUMENTS

| | | | |
|---|---|---|---|
| CN | 203506669 | U | 4/2014 |
| EP | 1665975 | A1 | 6/2006 |
| EP | 3888522 | A1 | 10/2021 |
| JP | H1024005 | A | 1/1998 |
| WO | 03/055375 | A1 | 7/2003 |

* cited by examiner

*Primary Examiner* — Levon J Shahinian
(74) *Attorney, Agent, or Firm* — McGarry Bair PC

(57) ABSTRACT

A dishwasher for treating dishes according to a cycle of operation, the dishwasher having a tub at least partially defining a treating chamber and a first dish rack received within the treating chamber, and having a least a portion with a seat for supporting dishes. A second dish rack is located above the first dish rack and includes a movable section.

20 Claims, 9 Drawing Sheets

DISHWASHER WITH RACK

BACKGROUND

Contemporary automatic dishwashers for use in a typical household can include a tub and one or more dish holders, such as upper and lower racks or baskets, for supporting dishes within the tub. Optionally, some dishwashers come with a third or top rack located in the tub above the upper rack. A spray system is provided for re-circulating wash liquid throughout the tub to remove soils from the dishes loaded into the racks. The dishwasher can also include a controller that implements a number of pre-programmed cycles of operation to wash dishes contained in the tub.

BRIEF DESCRIPTION

The disclosure relates to a dishwasher for treating dishes according to a cycle of operation, the dishwasher comprising a tub at least partially defining a treating chamber; a first dish rack received within the treating chamber, and having a least a portion with a seat for supporting dishes; a second dish rack located above the first dish rack and having movable section movable between a deployed position and a stowed position; wherein in the deployed position, the movable section defines a first height with the seat, and in the stowed position, the movable section defines a second height with the seat, the second height being greater than the first height.

Another aspect of the disclosure relates a dishwasher for treating dishes according to a cycle of operation, the dishwasher comprising a tub at least partially defining a treating chamber; a first dish rack received within the treating chamber, and having a least a portion with a seat for supporting dishes; a second dish rack located above the lower dish rack and having a first wash zone and a second wash zone; and a movable spray tube movable between to first position and a second position; wherein in the first position, the spray tube defines a first height with the seat, and in the second position, the spray tube defines a second height with the seat, the second height being greater than the first height.

DETAILED DESCRIPTION

Figure 1:
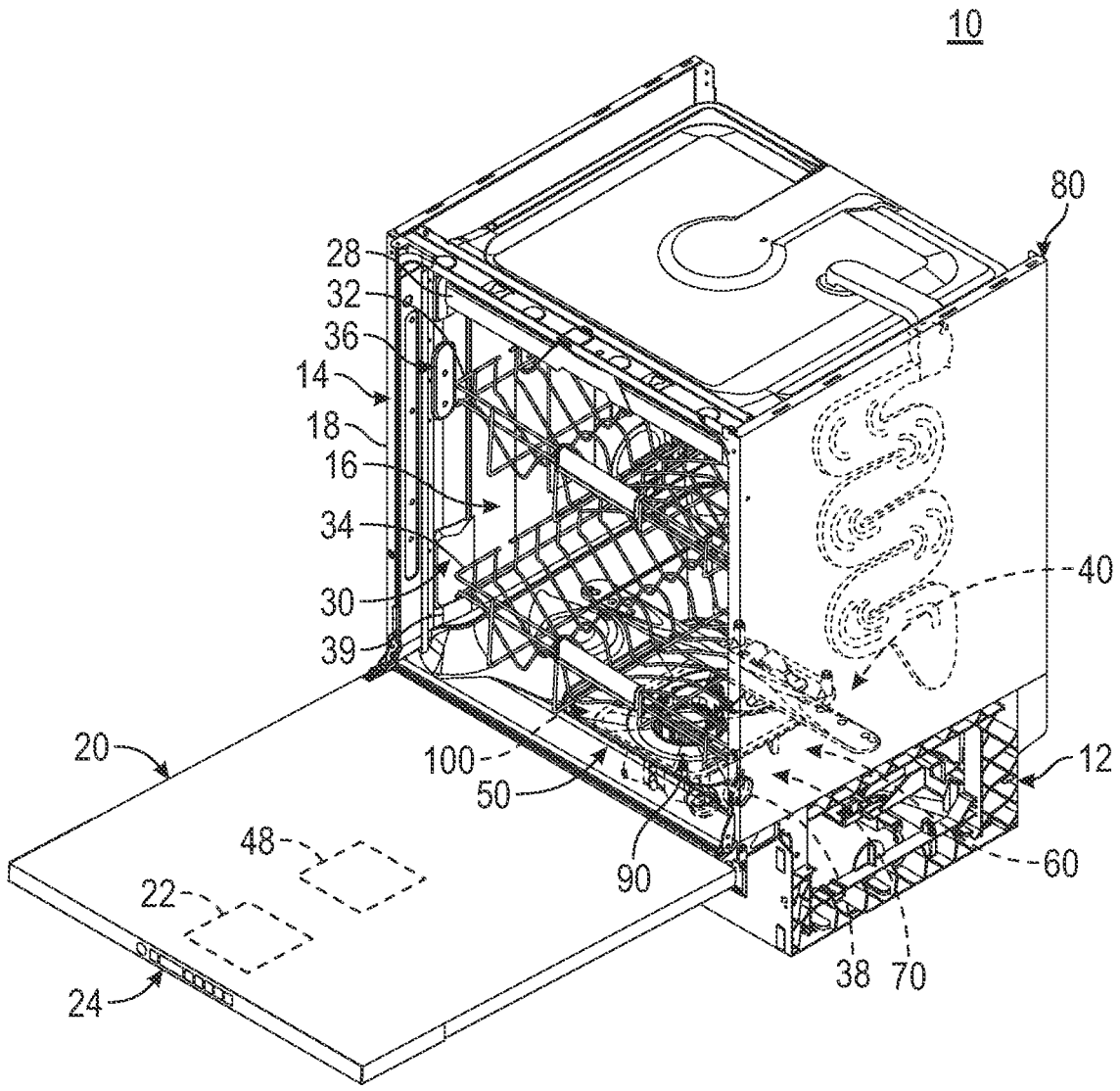
FIG. 1 is a right-side perspective view of an automatic dishwasher having multiple systems for implementing an automatic cycle of operation and including a dish rack.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported an open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items. While illustrated as a single panel, multiple parts can together define the door assembly 20.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can include the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within or moveably received by the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36 and movably received within the treating chamber 16. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
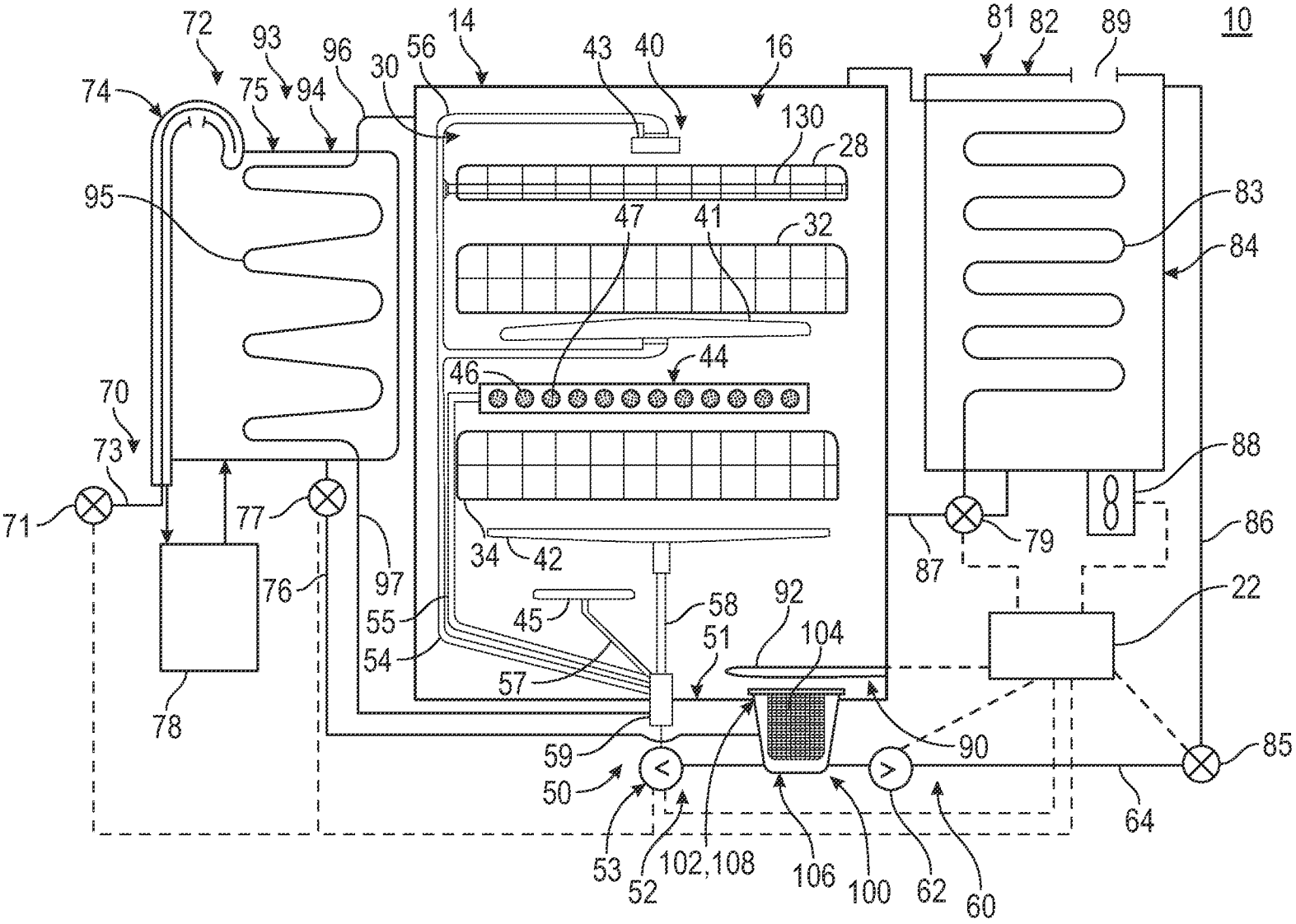
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are illustrated as rotating spray arms, located below the upper dish rack 32 and the lower dish rack 34, respectively, and rotate about a generally centrally located and vertical axis. However, it is contemplated that the upper spray arm 41 or the lower spray arm 42 can be fixed. The third level sprayer 43 is located above the third level rack 28. The third level sprayer 43 is illustrated as being fixed, but could move, such as in rotating. In addition to the third level sprayer 43 or in place of the third level sprayer 43, a sprayer 49, illustrated as a stationary sprayer, can be located at least in part below a portion of the third level rack 28. The sprayer 49 is illustrated as a having a fixed or stationary sprayer housing or tube, carried by the third level rack 28, but the sprayer housing or tube could move, such as, but not limited to, rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 43, 44, 45, 49 to the recirculation pump 53. A recirculation valve 59 can selectively fluidly couple each of the conduits 54-58 to the recirculation pump 53. While each sprayer 43, 44, 45, 49 is illustrated as having a corresponding dedicated supply conduit 54-58 one or more subsets, comprising multiple sprayers from the total group of sprayers 43, 44, 45, 49, can be supplied by the same conduit, negating the need for a dedicated conduit for each sprayer. For example, a single conduit can supply the upper spray arm 41 and the third level sprayer 43. Another example is that the sprayer 49 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be considered or accounted for when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
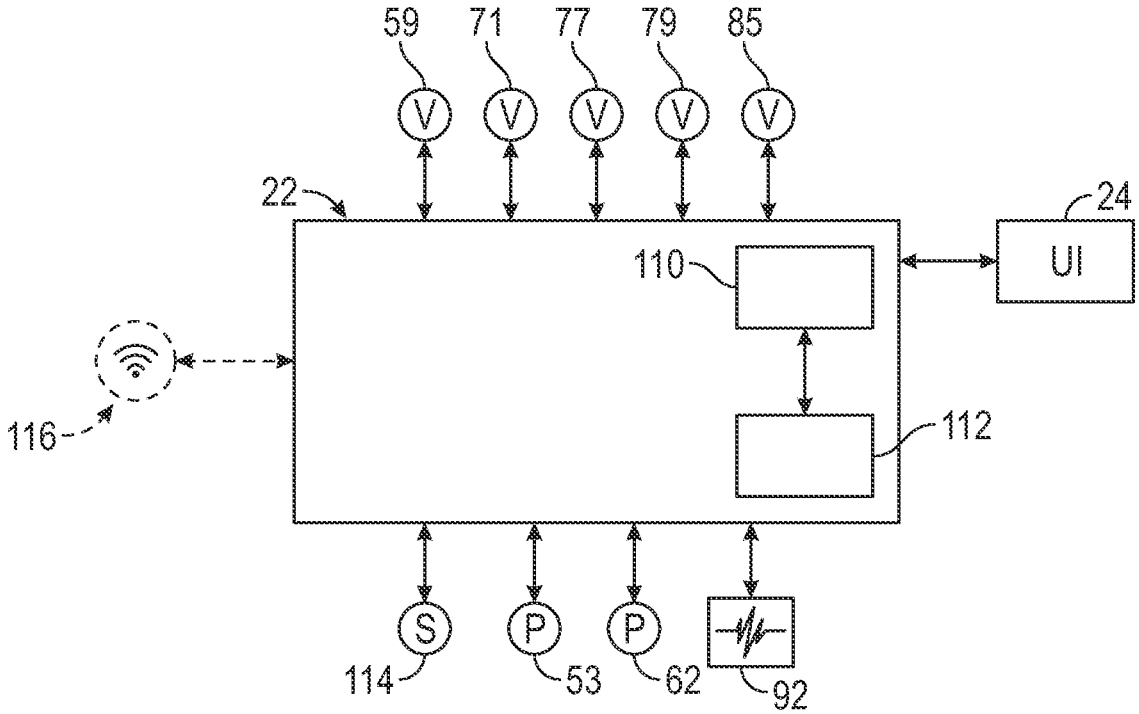
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
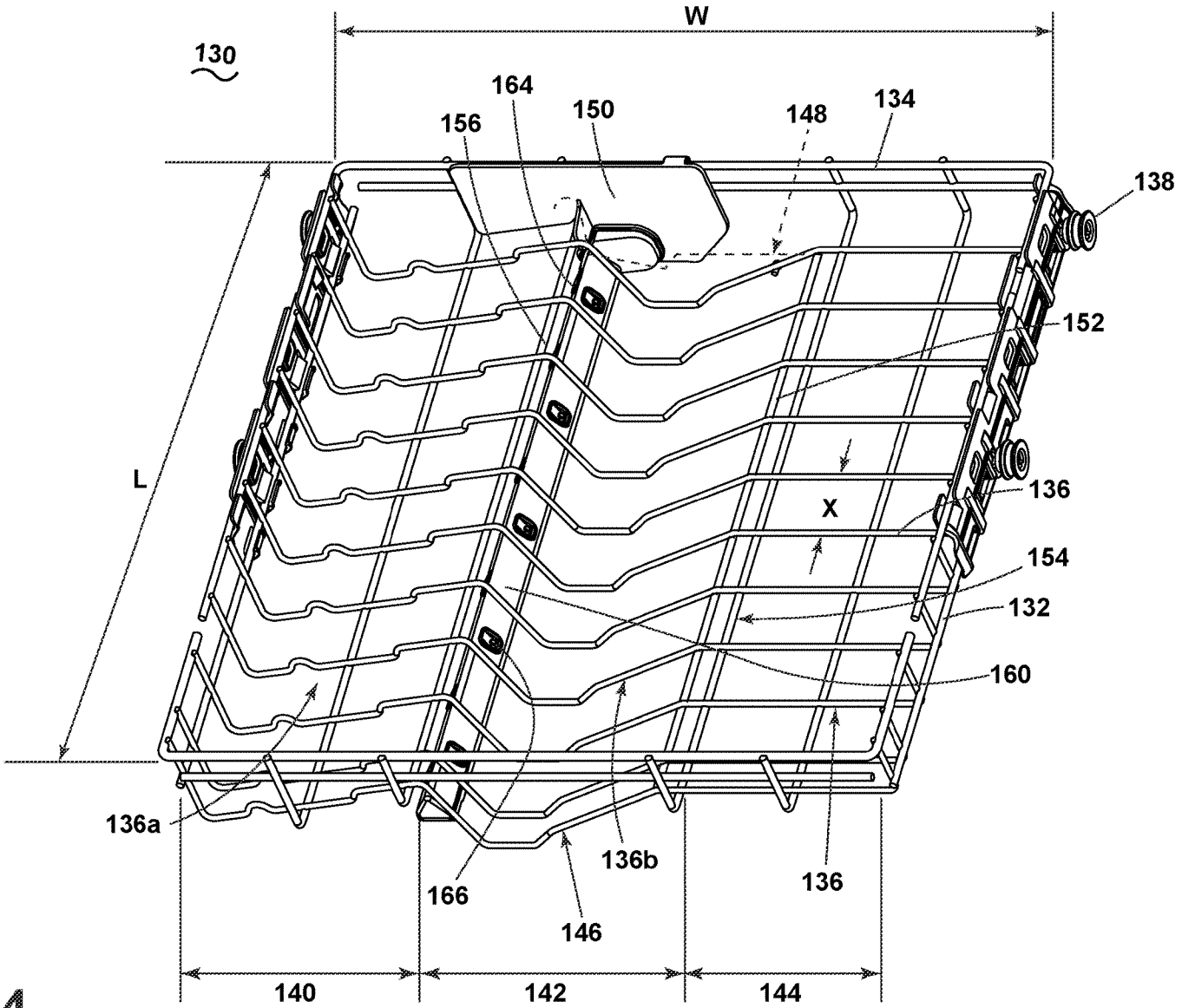
FIG. 4 is a perspective view an upper dish rack for the dishwasher of FIG. 1 with a movable section in a deployed position.

FIG. 4 is a perspective view of a dish rack 130, by way of non-limiting example the third level rack 28 or the upper dish rack 32. The dish rack 130 can be defined by a frame 132 including an upper rim 134. The frame 132 can be defined by wires 136 spaced apart a distance (X). The frame 132 can have a length (L) and a width (W). The frame 132 can be mounted to a set of wheels 138 for moving the dish rack 130 into and out of the treating chamber 16 (FIG. 1). The frame 132 can be separated into multiple sections, a first section 140, a second section 142, and a third section 144 with distinct wires 136 defining each section. In other words, three separate sets of wires, a first set of wires 136*a*, a second set of wires 136*b*, and a third set of wires 136*c* define each section 140, 142, 144 respectively. The dish rack 130 as described herein can be formed by wire-frame construction, injection molding, or any suitable manufacturing known in the art.

Figure 6:
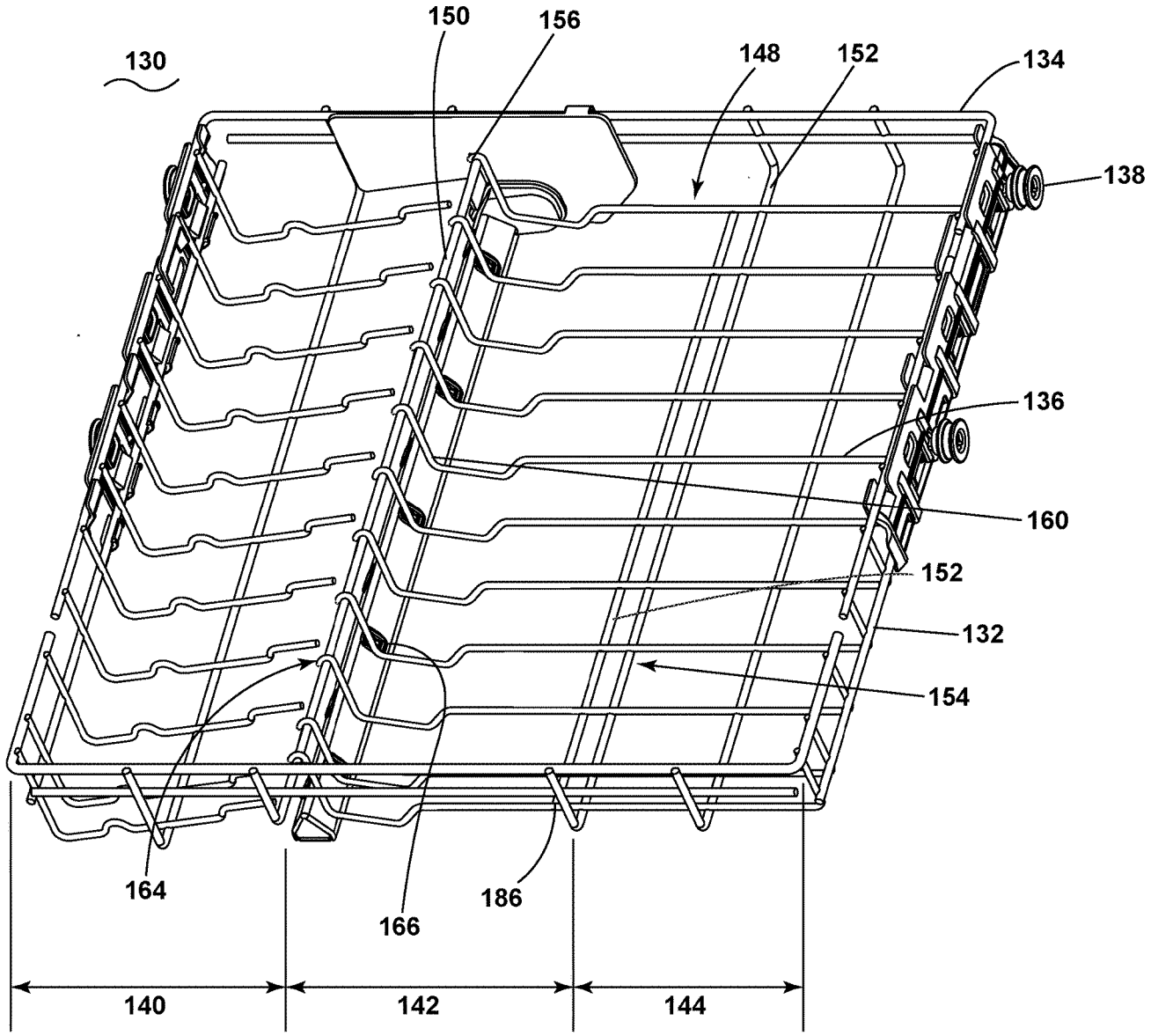
FIG. 6 is a perspective view the dish rack from FIG. 4 with the movable section in a stowed position.

In one aspect of the disclosure the second section 142 is a movable section movable between a deployed position 146 and a stowed position 148 (dashed line, and FIG. 6). A stowed position holder 150 can be located proximate the rim 134 of the frame 132. The stowed position holder 150 can extend along the length (L) of the frame 132. A pivot connection 152 moveably couples the second section 142 to the frame 132. More specifically, the pivot connection 152 connects the second section 142 to the third section 144 which is an adjacent stationary section. The pivot connection 152 can define a meeting edge 154 of the second and third sections 142, 144. The pivot connection 152 can extend the length (L) of the frame 132. In one aspect the pivot connection 152 can connect sequential wires 136 in the second set of wires 136*b*.

The second section 142 can be spaced from and facing the first section 140 at hooked distal ends 156 to define a border between the first and second sections 140, 142. A spray tube 160 can extend the length (L) of the frame 132 and be disposed beneath the frame 132 proximate the border 162. A first set of nozzles 164 can be provided in the spray tube 160 and face the first section 140. A second set of nozzles 166 can be provided in the spray tube 160 and face the second section 142.

It should be understood that while illustrated as having three wash zones, any number of wash zones is contemplated, including one. Further, while illustrated as being a middle section, the second section can be located anywhere in the dish rack.

Figure 5:
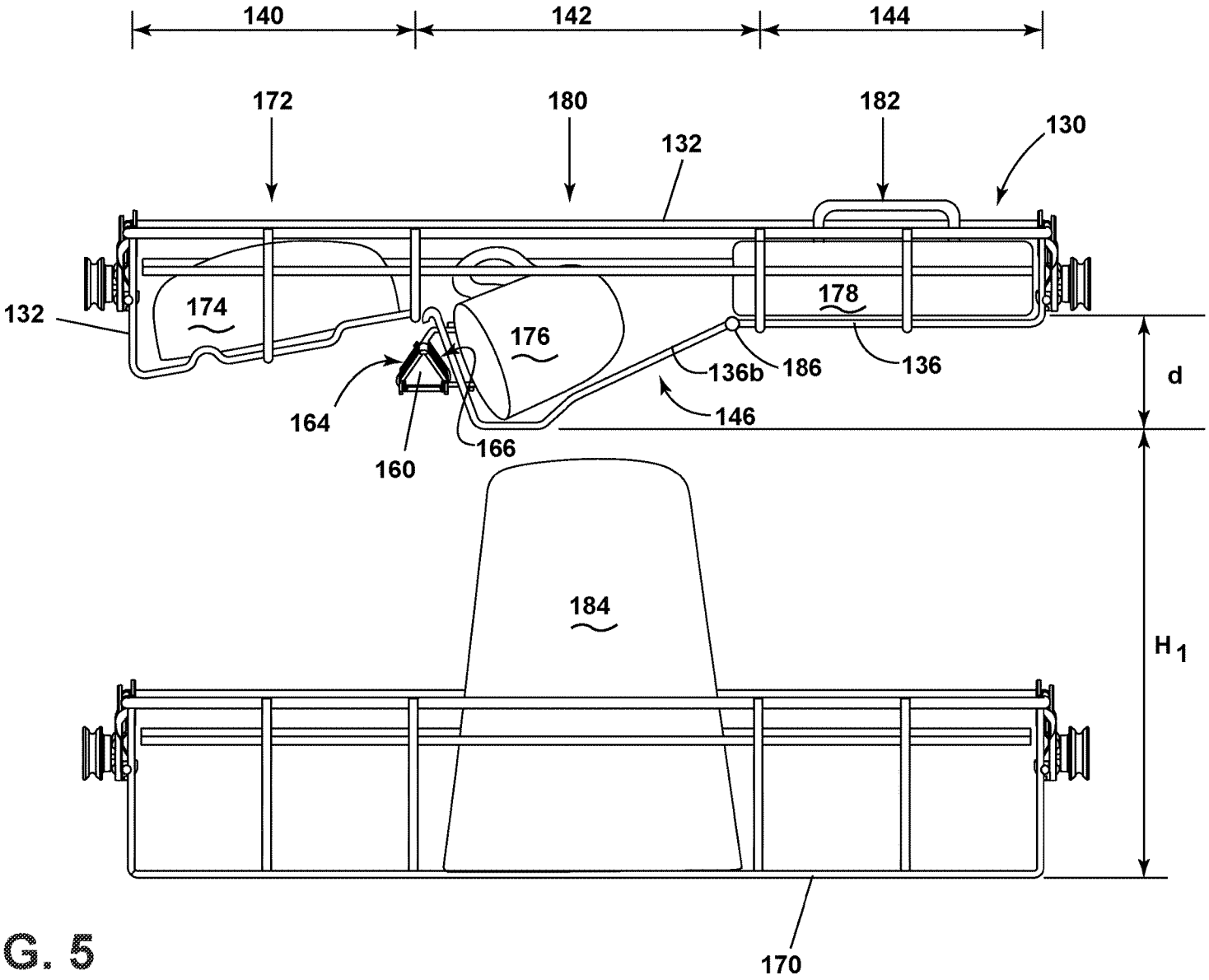
FIG. 5 is a front view of the upper dish rack from FIG. 4 with a lower dish rack below the upper dish rack.

FIG. 5 is a front view of the dish rack 130 from FIG. 4 with a second rack 170 disposed beneath the dish rack 130. The second rack 170 can by way of non-liming example the upper dish rack 32 or the lower dish rack 34 depending on whether the dish rack 130 is the third level rack 28 or the upper dish rack 32 respectively. The first section 140 along with the first set of nozzles 164 can define a first wash zone 172. The first section 140 can hold dishes, sized similarly to a bowl 174 as illustrated. The third section 144 can define a third wash zone 182 for items stowed in a cutlery tray 178.

The second section 142 in the deployed position 146 along with the second set of nozzles 166 can define a second wash zone 180. It can more clearly be seen that when in the deployed position 146, the second section 142 is deeper at a lowest point 158 with respect to the first and third sections 140, 144. An additional depth (d) provides room for dishes, sized similarly to a mug 176 as illustrated. When the second section is in the deployed position 146, typical dishes 184 of less than a first height (H1) can be placed in the second rack 170. The first height (H1) measured between a seat 168 of the second rack and the lowest point 158 of the second section 142.

FIG. 6 is a perspective view of the dish rack 130 with the second section 142 in the stowed position 148. The pivot connection 152 can define a pivot point 186 such that the entire second section 142 can be rotated about the pivot point 186 toward the rim 134. When in the stowed position 148, the hooked distal ends 156 can engage the stowed position holder 150. While illustrated as hooked distal ends 156, any suitable engagement of the second section 142 in the stowed position 148 is contemplated.

Figure 7:
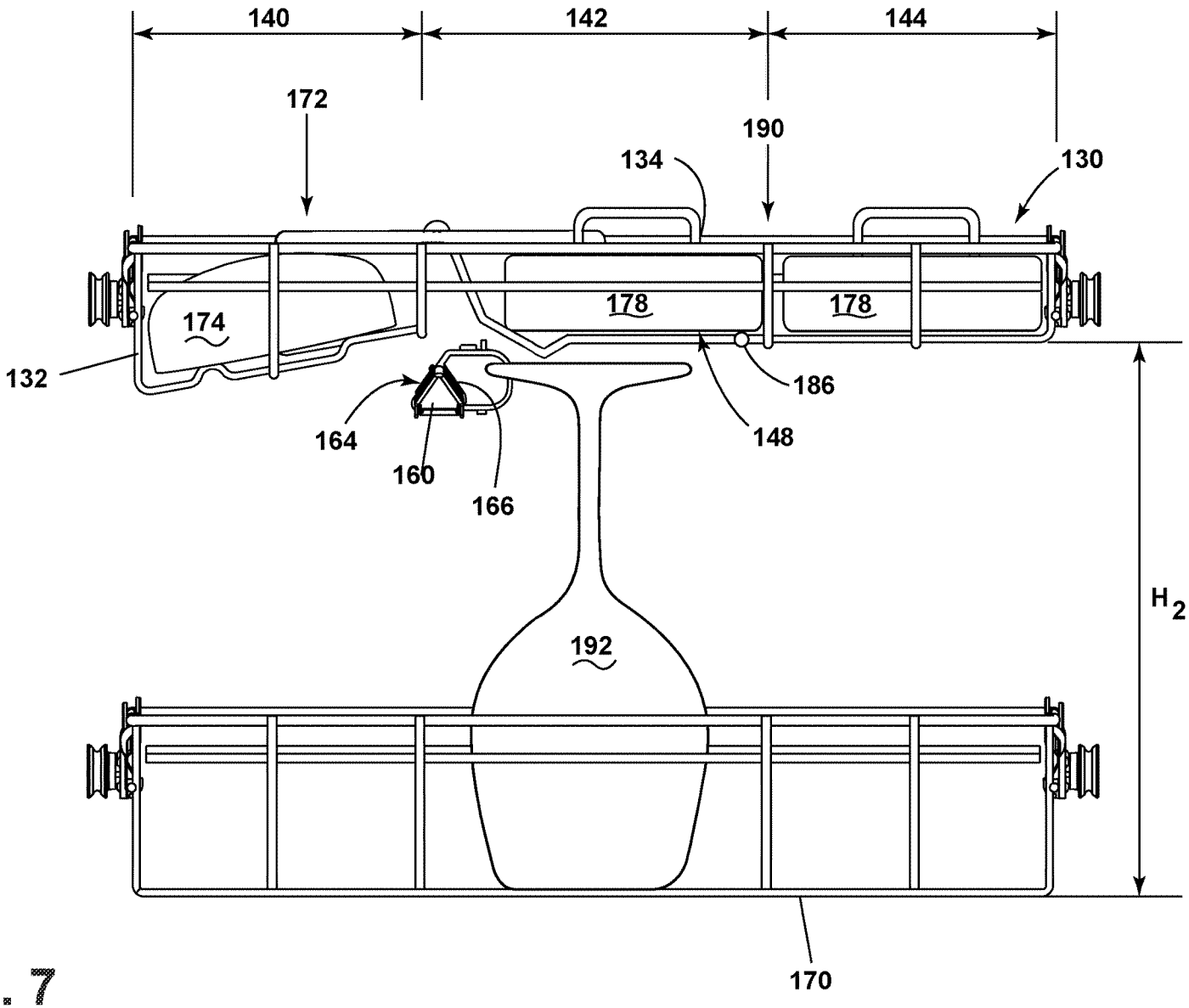
FIG. 7 is a front view of the dish rack from FIG. 6 with the lower dish rack below the upper dish rack.

Turning to FIG. 7, it can more clearly be seen that in the stowed position 148 the second and third sets of wires 136*b*, 136*c* combine to define a fourth wash zone 190. The fourth wash zone 190 is a combination of the second and third wash zones 180, 182. The fourth wash zone 190 can be large enough to receive two cutlery trays 178 as illustrated.

The front view of the dish rack 130 with the second rack 170 disposed beneath clearly illustrates that when the second section 142 is in the stowed position 148, tall dishes 192 that are greater than the first height (H1) and less than a second height (H2) can be placed in the second rack 170.

Figure 8:
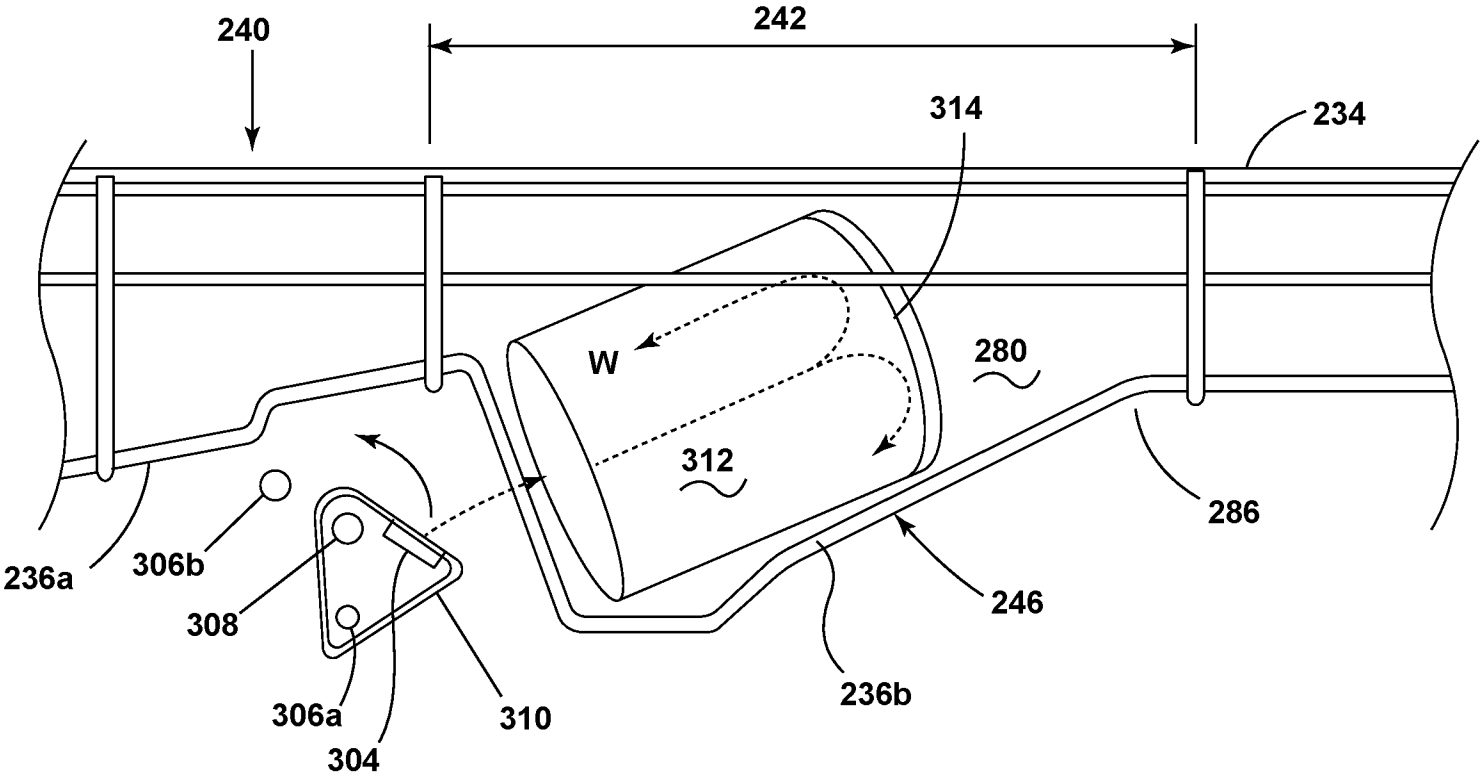
FIG. 8 is an enlarged view of the front of an upper dish rack for the dishwasher of FIG. 1 according to another aspect of the disclosure herein with a movable section in a deployed position.

FIG. 8 is an enlarged view of portion of a dish rack 230 according to another aspect of the disclosure herein. The dish rack 230 is similar to the dish rack 130 therefore, like parts will be identified with like numbers increased by 100, with it being understood that the description of the like parts of the dish rack 130 dish rack 230 unless otherwise noted.

The dish rack 230 can include a second section 242 defined by a second set of wires 236*b*. When in a deployed position 246, the second set of wires 236*b* can define at least a portion of a second wash zone 280.

A wash system 300 can be provided below a frame 232 of the dish rack 230. The wash system 300 can further define the second wash zone 280. The wash system 300 can include a spray tube 302, having at least one sprayer 304, a set of plugs 306, and a port 308. The set of plugs 306 can include a first plug 306*a* and a second plug 306*b*. The port 308 can be fluidly coupled to a water supply, by way of non-limiting example the water supply system 70 previously mentioned. The spray tube 302 can be rotatably mounted to a back of the dishwasher 10. It is further contemplated that the spray tube 302 is rotatably mounted to a first section 240 of the dish rack 230 defined by a first set of wires 236*a*. Regardless of the mounting position, the spray tube 302 can be configured to rotate in a counter clock-wise direction (CCW) from a first position 310. The spray tube 302 can be engaged with the first plug 306*a* and the port 308 when in a first position 310.

The first position 310 can be an "on position" such that the water tube 302 is open to the water supply and spray water (W) enters the water tube 302 and exits toward the second wash zone 280. In one non-limiting example the second wash zone 280 can include a cup 312, and the spray water (W) can directly enter the cup 312 such that the spray water (W) contacts a bottom 314 of the cup 312 enabling effective and direct cleaning of the cup 312.

Figure 9:
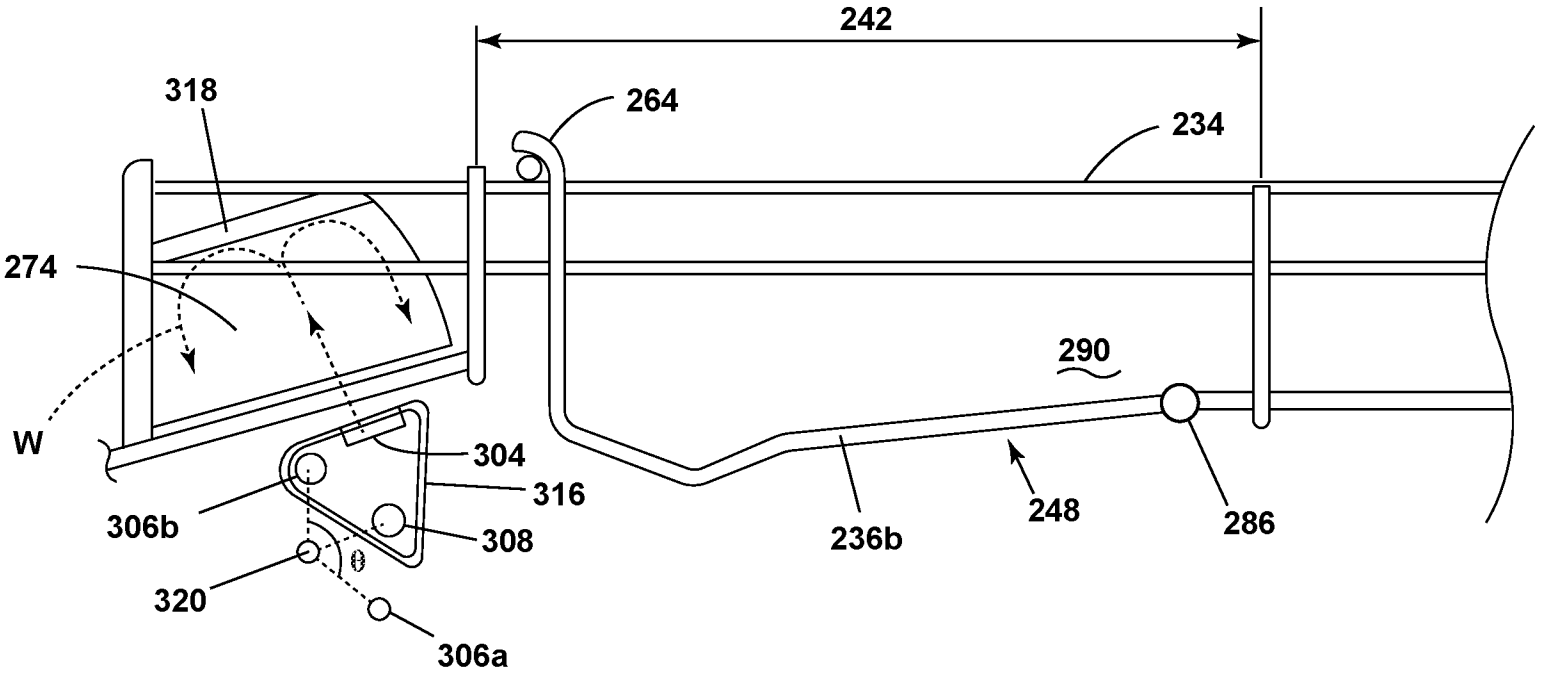
FIG. 9 is an enlarged view of the front of an upper dish rack for the dishwasher of FIG. 1 according to another aspect of the disclosure herein with a movable section in a stowed position.

Turning to FIG. 9, when in a stowed position 248, the second set of wires 236*b* can define at least a portion of a fourth wash zone 290. Further, to make more room for dishes in a rack below the dish rack 230, the spray tube 302 can also be rotated to a second position 316 from the first position 310 (FIG. 8). In the second position 316 the spray tube can be engaged with the second plug 306*b* and the port 308. It is contemplated that in the second position 316 the spray tube 302 is in an "off position" such that the water supply has been cut off and no spray water is entering the spray tube 302. Each of the first and second plugs 306*a*, 306*b* can be oriented about a rotational axis 320 at an angle (θ) clockwise and counter clockwise from the port 308 respectively. In one non-limiting example the angle is 60 degrees.

It is further contemplated that the second position 316 can be another "on position" such that the water tube 302 is open to the water supply and spray water (W) enters the water tube 302 and exits toward a first wash zone 272. In one non-limiting example the first wash zone 272 can include a bowl 274, and the spray water (W) can directly enter the bowl 274 such that the spray water (W) contacts a bottom 318 of the bowl 274 enabling effective and direct cleaning of the bowl 274.

While "a set of" or "a plurality of" various elements will be described, it will be understood that "a set" or "a plurality" can include any number of the respective elements, including only one element. It should be understood that the term dishes herein can be cutlery, glasses, bowls, plates, appliance parts, cooking utensils, or the like.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to a cycle of operation, the dishwasher comprising:

a tub at least partially defining a treating chamber;

a first dish rack received within the treating chamber, and having a least a portion with a seat for supporting dishes; and a second dish rack located above the first dish rack, the second dish rack defined by a frame including an upper rim and the second disk rack having at least one section movable between a deployed position, wherein the at least one section is spaced from the upper rim to define a depth of the at least one section from the upper rim, and a stowed position, wherein the at least one section is located proximate the upper rim;

wherein, in the deployed position, a lowest point of the at least one section defines the depth of the at least one section and defines a first height with the seat, and, in the stowed position, the lowest point of the at least one section defines a second height with the seat, the second height being greater than the first height and the depth of the at least one section from the upper rim being deeper in the deployed position than in the stowed position.

2. The dishwasher of claim 1 wherein the second dish rack is defined by at least a first set of wires and a second set of wires, separate from the first set of wires, the second set of wires at least partially defining the at least one section.

3. The dishwasher of claim 2 wherein the first set of wires is stationary.

4. The dishwasher of claim 3 further comprising a third set of wires that is stationary and wherein the second set of wires is disposed between the first and third set of wires.

5. The dishwasher of claim 4 further comprising a pivot connection for connecting sequential wires in the second set of wires.

6. The dishwasher of claim 5 wherein the pivot connection defines a pivot axis about which the second set of wires rotates.

7. The dishwasher of claim 6 wherein the pivot connection defines a meeting edge between the second set of wires and the third set of wires.

8. The dishwasher of claim 1 further comprising a spray tube having at least one set of nozzles oriented toward the at least one section when in the deployed position.

9. The dishwasher of claim 8 wherein the at least one section is multiple sections defining at least a first wash zone and a second wash zone.

10. The dishwasher of claim 9 wherein the spray tube is rotatable between a first position and a second position.

11. The dishwasher of claim 10 wherein the spray tube is fluidly coupled to a water supply and the at least one nozzle faces the second wash zone when in the first position.

12. The dishwasher of claim 11 wherein the spray tube is closed to a water supply when in the second position.

13. The dishwasher of claim 11 wherein the spray tube is open to a water supply and the at least one nozzle faces the first wash zone when in the second position.

14. A dishwasher for treating dishes according to a cycle of operation, the dishwasher comprising:

a tub at least partially defining a treating chamber;

a first dish rack received within the treating chamber, and having a least a portion with a seat for supporting dishes;

a second dish rack located above the first dish rack and having a first wash zone and a second wash zone; and a spray tube movable between a first predetermined position and a second predetermined position and having at least one sprayer;

wherein in the first predetermined position, the spray tube defines a first height with the seat and the at least one sprayer is positioned to face the second wash zone is configured to provide water from the spray tube toward the second wash zone, and in the second predetermined position, the spray tube defines a second height with the seat, the second height being greater than the first height, and the at least one sprayer is positioned to face the first wash zone.

15. The dishwasher of claim 14 wherein the at least one sprayer includes at least one set of nozzles.

16. The dishwasher of claim 15 wherein the spray tube is fluidly coupled to a water supply to provide the water from the spray tube toward the second wash zone when in the first predetermined position.

17. The dishwasher of claim 16 wherein the spray tube is closed to a water supply when in the second predetermined position.

18. The dishwasher of claim 16 wherein the spray tube is open to a water supply and the at least one set of nozzles faces the first wash zone when in the second predetermined position.

19. The dishwasher of claim 14 wherein the second dish rack further comprises at least one section movable between a deployed position and a stowed position.

20. The dishwasher of claim 19 wherein the deployed position is associated with the first predetermined position of the spray tube and the stowed position is associated with the second predetermined position of the spray tube.

* * * * *